US008956241B2

(12) United States Patent
Overly

(10) Patent No.: US 8,956,241 B2
(45) Date of Patent: Feb. 17, 2015

(54) GOLF CLUB FOR BUMP AND RUN GOLF SHOT

(76) Inventor: Joseph Overly, Fiskdale, MA (US)

( * ) Notice: Subject to any disclaimer, the term of this patent is extended or adjusted under 35 U.S.C. 154(b) by 52 days.

(21) Appl. No.: 13/530,309

(22) Filed: Jun. 22, 2012

(65) Prior Publication Data

US 2013/0157775 A1 Jun. 20, 2013

Related U.S. Application Data

(60) Provisional application No. 61/506,742, filed on Jul. 12, 2011.

(51) Int. Cl.
*A63B 69/36* (2006.01)
*A63B 53/04* (2006.01)

(52) U.S. Cl.
USPC ..... 473/313; 473/314; 473/340

(58) Field of Classification Search
USPC ..... 473/251, 255, 313, 340, 305, 314, 473/334–339
See application file for complete search history.

(56) References Cited

U.S. PATENT DOCUMENTS

| | | | | | |
|---|---|---|---|---|---|
| D27,190 | S | * | 6/1897 | Oran | D21/750 |
| 3,077,350 | A | * | 2/1963 | Koorland | 473/251 |
| D334,606 | S | * | 4/1993 | Cameron | D21/751 |
| D335,692 | S | | 5/1993 | Antonious | |
| 5,855,524 | A | * | 1/1999 | Jenkins | 473/294 |
| 6,464,598 | B1 | * | 10/2002 | Miller | 473/314 |
| 6,605,006 | B2 | * | 8/2003 | Mason | 473/252 |
| 6,623,375 | B2 | * | 9/2003 | Davies | 473/314 |
| 6,699,140 | B1 | * | 3/2004 | Sun | 473/252 |
| 6,979,269 | B1 | | 12/2005 | Nohara | |
| 7,014,566 | B1 | * | 3/2006 | Norvise | 473/231 |
| 7,297,071 | B2 | * | 11/2007 | Hyman | 473/305 |
| 7,309,295 | B2 | * | 12/2007 | Solari | 473/328 |
| 8,506,415 | B2 | * | 8/2013 | Franklin | 473/251 |
| 2004/0214659 | A1 | * | 10/2004 | Lindsay | 473/340 |
| 2005/0277486 | A1 | * | 12/2005 | Hyman | 473/340 |
| 2007/0032311 | A1 | * | 2/2007 | Kajita | 473/340 |
| 2007/0123366 | A1 | * | 5/2007 | Solari | 473/349 |
| 2010/0197427 | A1 | * | 8/2010 | Wempe | 473/340 |
| 2011/0034267 | A1 | | 2/2011 | Lee | |
| 2013/0157775 | A1 | * | 6/2013 | Overly | 473/324 |

* cited by examiner

*Primary Examiner* — William Pierce
(74) *Attorney, Agent, or Firm* — Brian M. Dingman; Dingman, McInnes & McLane, LLP.

(57) ABSTRACT

A golf club head, and a golf club with the subject head. The head has a putter body that defines a front face and a golf club iron face that is integral with the putter body and presents an angled ball-striking face portion.

9 Claims, 6 Drawing Sheets

GOLF CLUB FOR BUMP AND RUN GOLF SHOT

CROSS REFERENCE TO RELATED APPLICATION

This application claims priority of Provisional Patent Application Ser. No. 61/506,742, filed on Jul. 12, 2011, the disclosure of which is incorporated herein by reference.

FIELD

The disclosure relates to a golf club.

BACKGROUND

A "bump and run" shot in golf involves using a lofted iron (e.g., a 7 or 8 iron) to hit the ball from the fringe of the green onto the green. The iron should be swung at the golf ball with a putting stroke which will create a low amount of loft of the golf ball and a short ball flight in the air, then when it lands on the ground it will roll out towards the intended target, the golf hole. However, lofted irons are gripped to be swung in an arc, while the shot should be taken using a putting stroke in which the club is taken back in a short low motion and then forward along the same path. Accordingly, the bump and run is difficult to master.

SUMMARY

The disclosure relates to a golf club that helps golfers with a specific golf shot—that is necessary for bumping a golf ball from off the green and having it run out to the golf hole. The club creates for the golfer a proper way of swinging a golf club that will promote a bump and run of a golf ball from off the green toward the hole. The subject golf club is like a combination putter club head and iron club head merged into one club head to provide the golfer with the look and feel of a putter which will promote a putting stroke, but at the same time it has a lofted face that will produce the ball flight accomplished by a golf club iron. The club may also have a putter grip, which promotes a putting stroke. The club makes it possible to swing an iron with a putting stroke and to make the bump and run golf shot easier to accomplish.

The disclosure features a golf club in which the head is like a combination putter and iron. It may also feature a reinforced housel neck that helps to support the club for golf ball contact. The subject club can be made as one club or a set of clubs offering a specific loft of club face made into each club for specific intended ball flights. Right and left handed designs are included.

The club is used by holding the grip, which can be a putter grip with a flat face in the front or a regular round grip, and swinging the golf club in a putting motion—a short low motion back from a golf ball then with the same type of motion forward, towards the golf ball and toward the intended target. Because the club has a putter grip and putter style club's look, it will help the golfer to use the putter stroke to make the bump and run shot more easily.

The club is used solely for hitting a golf ball from just off of a golfing green onto the green, to have the ball run out toward the intended target—the golf hole. This shot in golf is called the "bump and run" shot. The club makes it easier to make that one shot.

The parts to the non-limiting preferred embodiment of the club include:

The club head—this is like a putter but it has an iron club face.

The club has a reinforced hoiisel neck that adds stability to hitting golf balls.

The club has a designated loft for specific ball flight distance.

The club has a shaft in lengths ranging from 32 to 50 inches from the club head to the grip.

The club can have a putter style grip; a putter style grip is a grip that is rounded on the back side and flat on the front side. This grip can help the golfer to accomplish a putting stroke.

The disclosure herein includes a golf club head comprising a putter body that defines a front face and a golf club iron face that is integral with the putter body and presents an angled ball-striking face portion. The bottom of the ball-striking face portion may project in front of the front face of the putter body, and the top of the ball-striking face portion may be located behind the front face of the putter body. The face portion may be angled backward from vertical at one of about 21, 25, 29, 33, 37, 41, 45, 49, 52, 56 or 60 degrees. Also included herein is a golf club comprising the subject golf club head mounted on the end of a shaft. The golf club may further comprise a grip at the upper end of the shaft; the grip can be round, or can define a flat surface on its forward face. The shaft may have a length of either 32-36 inches, 41-46 inches, or 48-52 inches.

DESCRIPTION OF EXAMPLES

Figure 7:
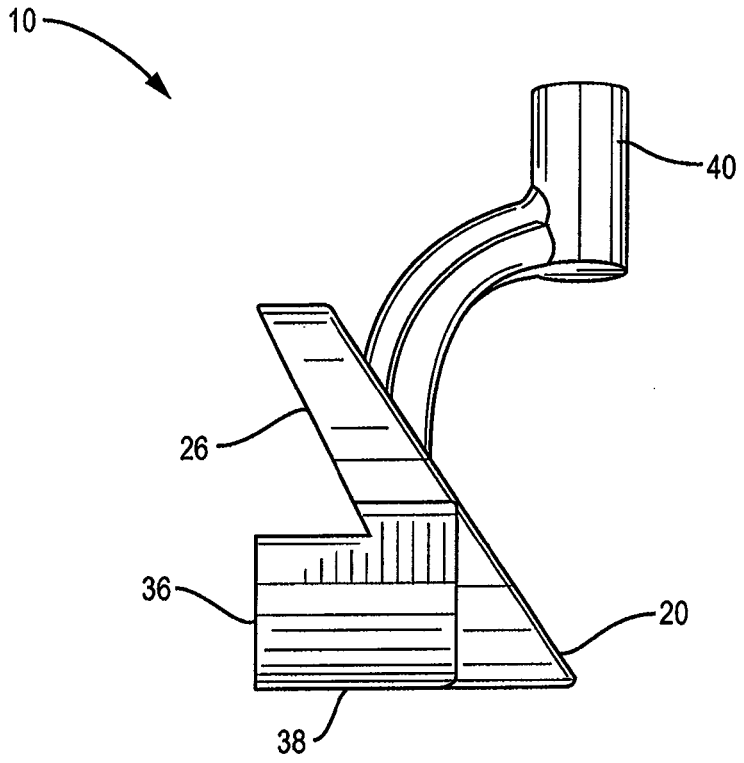
FIG. 7 is a right side view of the example golf club head.
Figure 8:
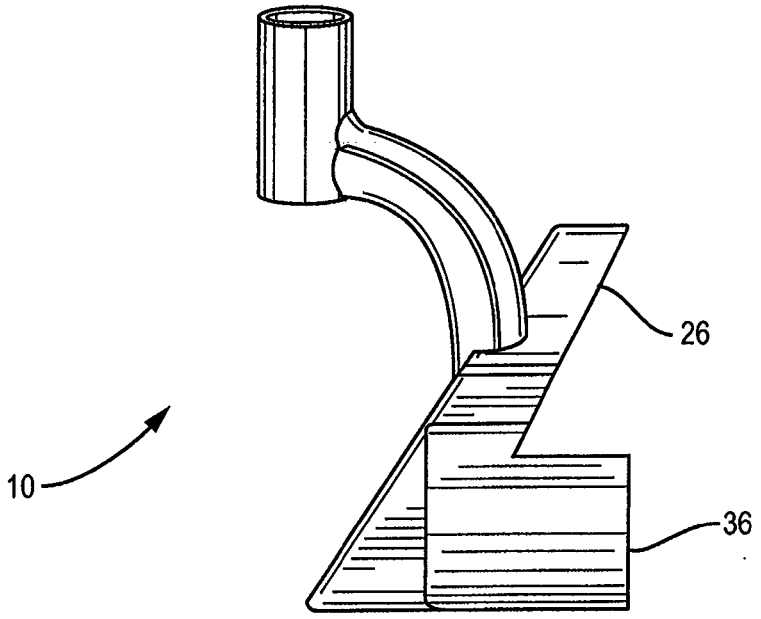
FIG. 8 is a left side view of the example golf club head.
Figure 9:
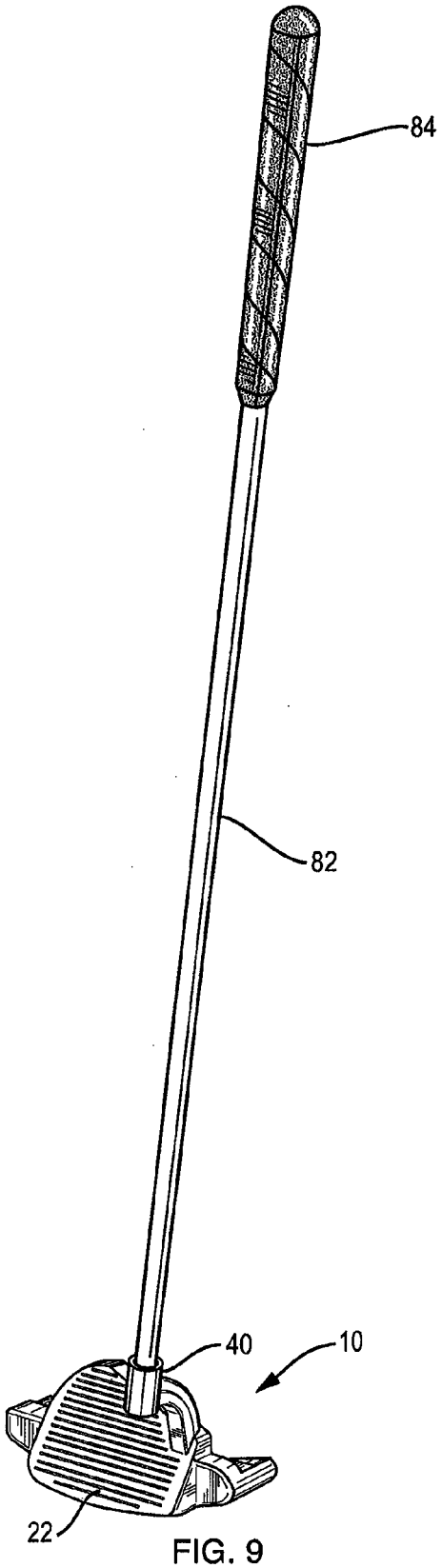
FIG. 9 is a front perspective view of an example of a golf club with the example golf club head.
Figure 10:
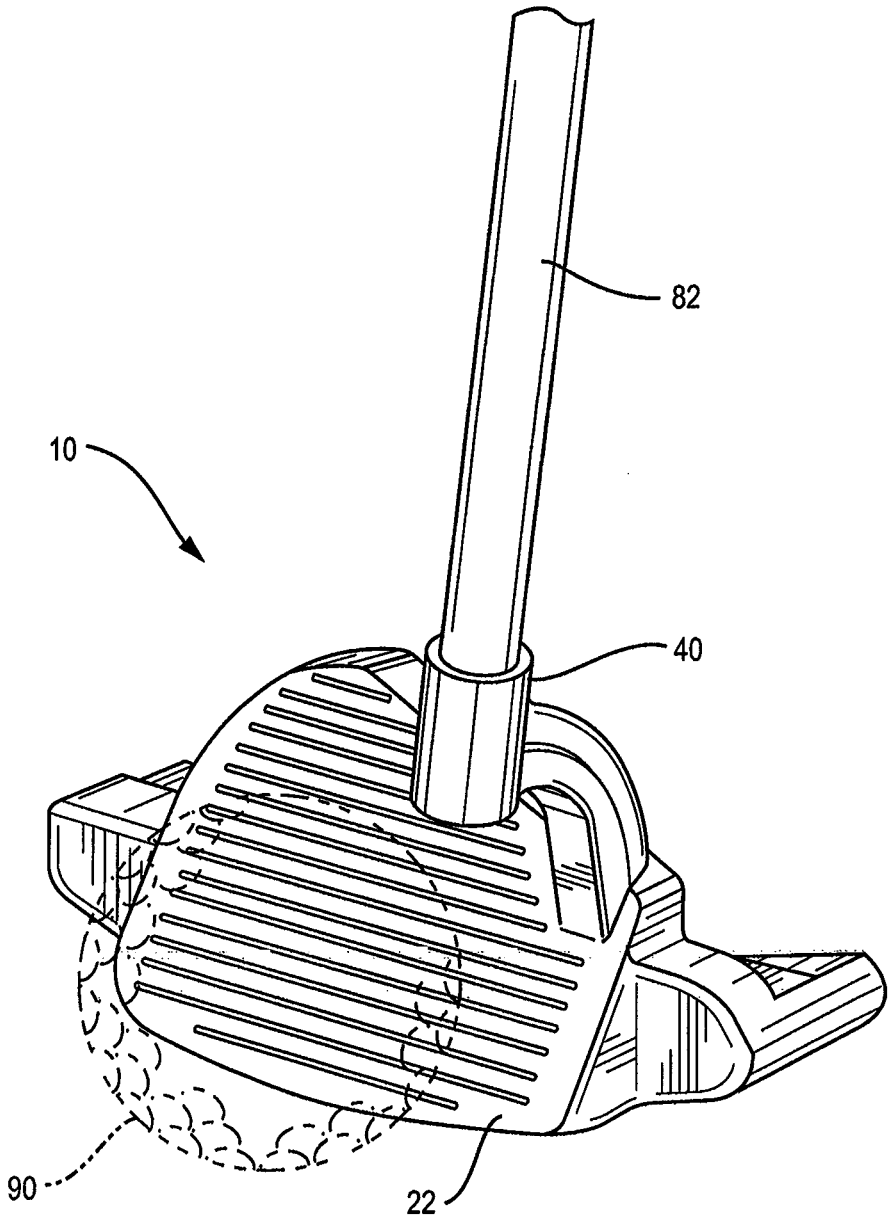
FIG. 10 illustrates the example golf club head striking a golf ball.

An example of the golf club head 10 is shown in FIGS. 1 through 8. The golf club head mounted to a shaft and with a putter grip, to accomplish a golf club, is shown in FIGS. 9 and 10.

Figure 1:
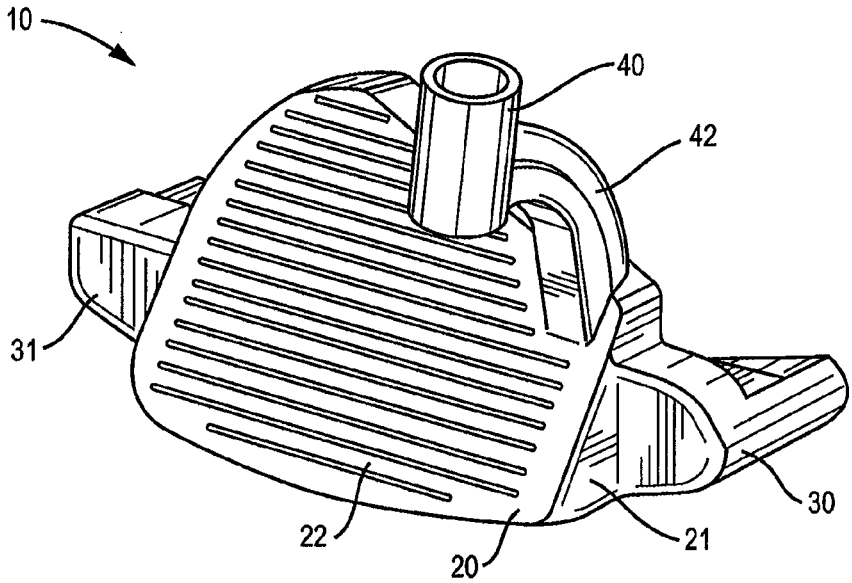
FIG. 1 is a front perspective view of an example of the subject golf club head.
Figure 2:
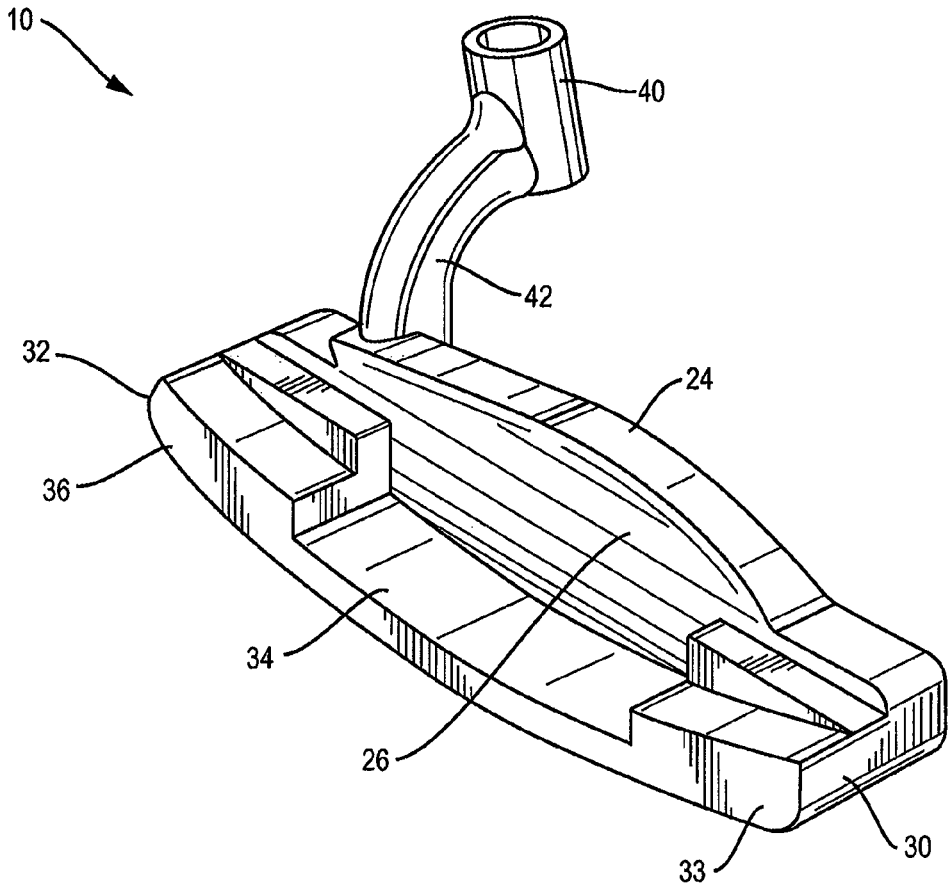
FIG. 2 is a rear perspective view of the example golf club head.
Figure 3:
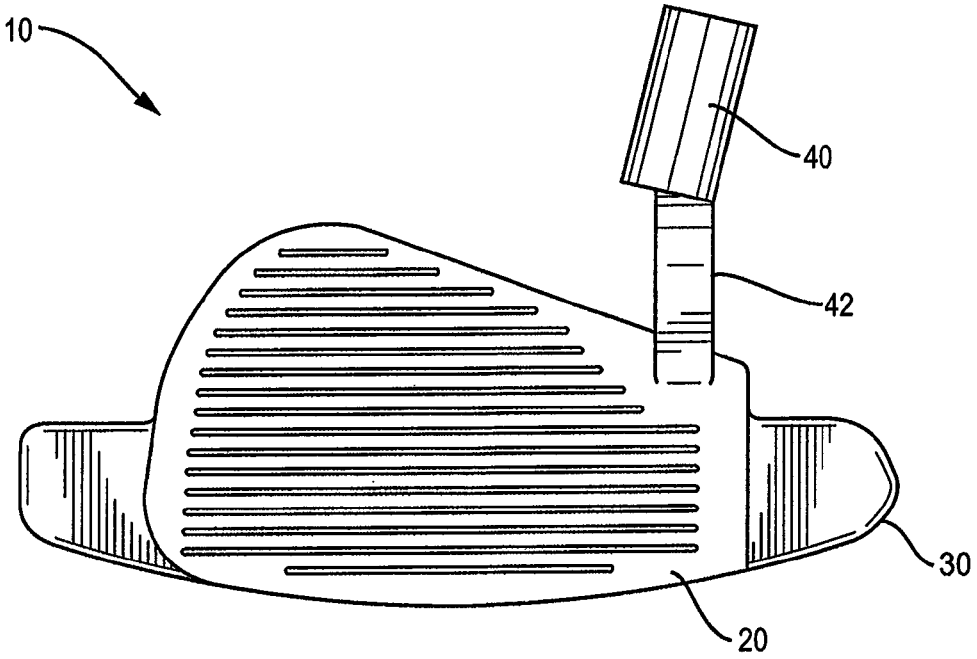
FIG. 3 is a front view of the example golf club head.
Figure 4:
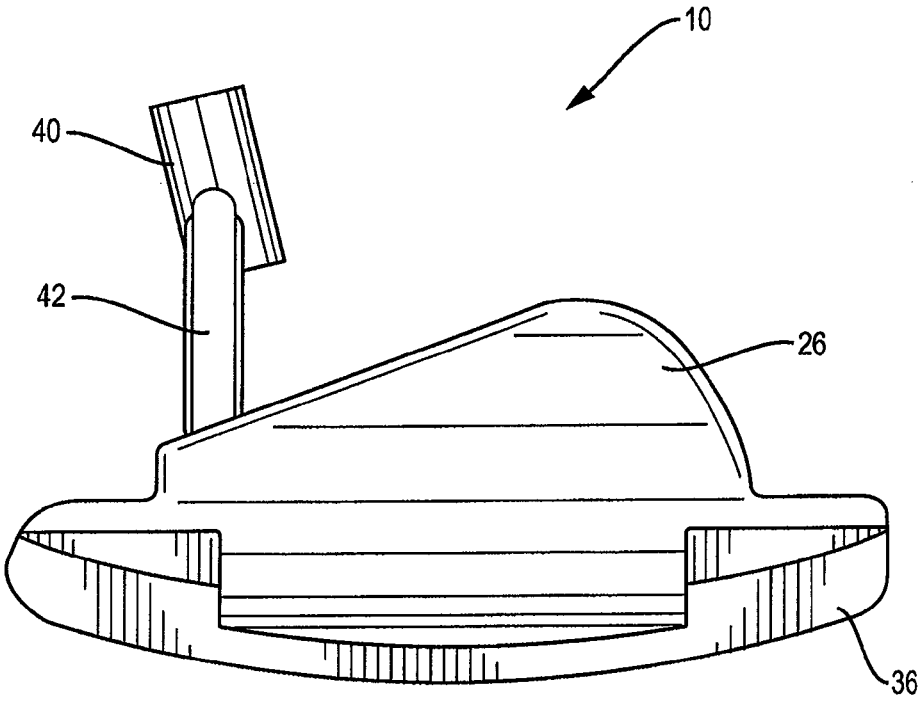
FIG. 4 is a rear view of the example golf club head.
Figure 5:
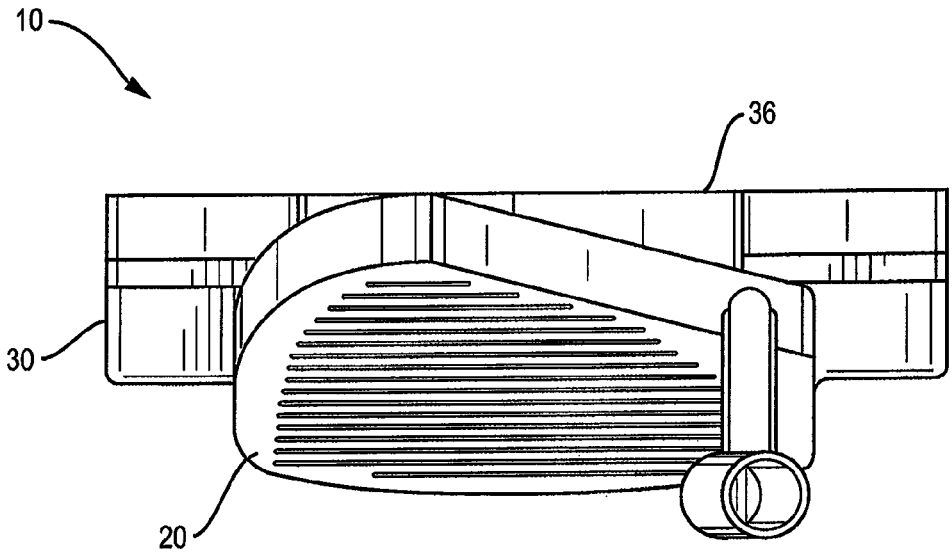
FIG. 5 is a top view of the example golf club head.

Golf club head 10 comprises body 30 that is shaped like a putter head, as is most apparent in the rear perspective view shown in FIG. 2. Part of the front face 31 of body 30 (which in a putter would comprise the vertical, planar ball striking face of the putter) is replaced with ball striking portion 20 that exactly mimics an iron, typically a 7 or 8 iron. Face 20 is angled backward from the vertical and defines a shape and contour that is essentially exactly the same as, or at least closely mimics, an iron. The result is a club that is swung like a putter but strikes the ball in part like an iron since the lofted face will typically lift the ball from the ground.

The preferred embodiment shows an offset style in which the hosel is offset from top 24 of the head. In an alternative embodiment not shown in the drawings, the hosel is in line with the head, as is known in the golf club art. The offset hosel is accomplished with neck 42 that projects from body 30.

Neck 42 can be reinforced. With the embodiment in which the hosel is not offset, hosel 40 would be directly connected to body 30 or perhaps would extend directly upward from the body a short distance. A second alternative (not shown in the drawings) is a golf club style hosel (as opposed to a putter style hosel). As shown in FIGS. 7, 8 and 9, the hosel 40 provides a location in which a shaft 82 may be inserted. The shaft 82 defines a center line which is parallel with the plane established by the vertical, planar face 31 of the putter body 30.

Figure 6:
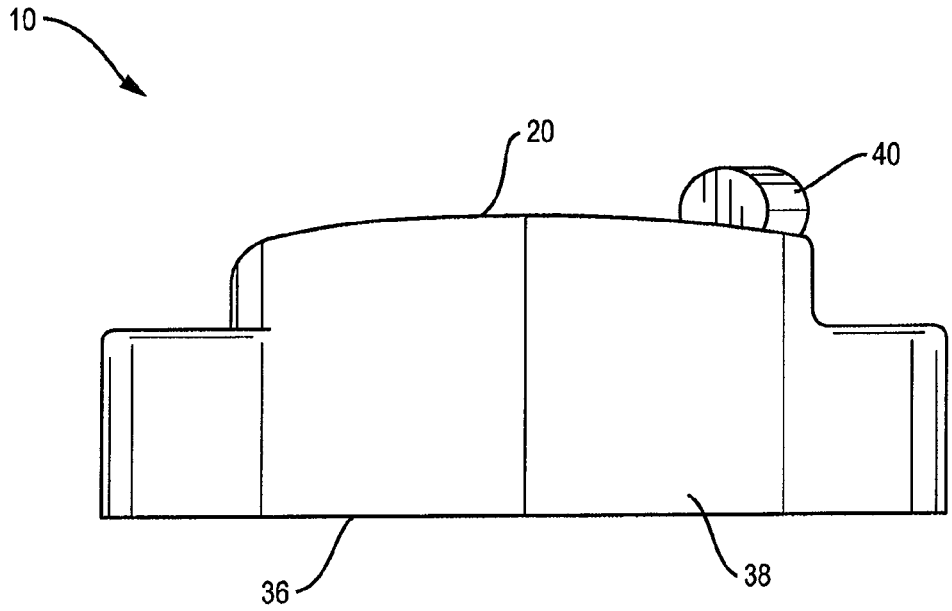
FIG. 6 is a bottom view of the example golf club head.

Golf club head 10 defines face 22 with its lowest edge projecting forward of front face 31 of body 30. This is accomplished by including an extension portion 21 that defines part of face 22. The bottom view of FIG. 6 shows bottom 38 of body 30 that further illustrates the projection of the lowermost forward edge of ball striking portion 20. Alternative embodiments can place the lowermost edge of face 22 either farther forward from body face 31, in line with body face 31, or perhaps even behind body face 31. The housel and neck are then designed to accommodate the particular location of face 22 and offset or non-offset design. The ball striking face can have a desired degree of loft. In order to mimic existing irons, the loft can be, for example, 21, 25, 29, 33, 37, 41, 45, 49, 52, 56 or 60 degrees.

The portion of body 30 that is not interrupted by ball striking portion 20 is identical or essentially the same as a traditional putter. Any and all types of putters are contemplated herein, including the traditional peripheral weighted style shown in the drawings, a mallet style (not shown), a blade style (not shown), or any other style. In this traditional offset design, peripheral portions 32 and 33 are more massive than center portion 34, thus moving mass away from the center line of the club to accomplish a peripheral weighting, as is known in the art. A blade style putter would typically have a more uniform height and depth to body 30, as is known in the art. A mallet style would have additional mass behind rear 36 of body 30, typically lying along the ball striking axis, also as known in the art.

Shaft 82 and grip 84 are any of the types that are traditionally used in any putter style. Typically a putter grip has a flat surface on the forward face, as shown in FIG. 9, however the subject club may alternatively have a regular iron grip that is rounded along its entire circumference. As shown in FIG. 10, when the club is swung, face 22 contacts ball 90. The loft will typically lift the ball from the ground for a short distance to help the golfer to move the ball out of the fringe and land the ball on the green, where desirably it rolls toward the cup. Shaft lengths can be as desired, for example traditional lengths of 32-36 inches, belly lengths of 41-46 inches, or long lengths of 48-52 inches.

Although certain features are shown in the drawings, this is not a limitation of the scope of the claimed invention, which is defined solely by the claims. What is claimed is:

The invention claimed is:

1. A golf club head, comprising:

a hosel that is constructed to be coupled to a shaft, where the shaft defines a center line;

a putter body that defines a front with a vertical, planar face which is parallel to the center line; and a golf club iron face that is integral with the putter body, has opposed lateral edges, and presents, with respect to the vertical planar face, an angled ball-striking face portion located between the lateral edges and that is constructed and arranged within the vertical, planar face so that each lateral edge of the iron face abuts part of the vertical, planar face.

2. The golf club head of claim 1 in which the bottom of the ball-striking face portion projects in front of the vertical, planar face.

3. The golf club head of claim 2 in which the top of the ball-striking face portion is located behind the vertical, planar face.

4. The golf club head of claim 3 in which the face portion is angled backward from vertical at one of about 21, 25, 29, 33, 37, 41, 45, 49, 52, 56 or 60 degrees.

5. A golf club comprising the golf club head of claim 1 mounted on a shaft having an upper and a lower end.

6. The golf club of claim 5 further comprising a grip at the upper end of the shaft.

7. The golf club of claim 6 wherein the grip defines a flat surface on its forward face.

8. The golf club of claim 7 wherein the shaft has a length of either 32-36 inches, 41-46 inches, or 48-52 inches.

9. A golf club consisting of:

a shaft that has a length of either 32-36 inches, 41-46 inches, or 48-52 inches, having an upper and a lower end;

a grip at the upper end of the shaft, wherein the grip defines a flat surface on its forward face;

a hosel that is constructed to be coupled to the shaft, where the shaft defines a center line; and a golf club head mounted at the lower end of the shaft and comprising a putter body that defines a front with a vertical, planar face which is parallel to the center line and a golf club iron face that is integral with the putter body, has opposed lateral edges, and presents, with resect to the vertical planar face, an angled ball-striking face located between the lateral edges and that is constructed and arranged within the vertical, planar face so that each lateral edge of the iron face abuts part of the vertical, planar face, wherein the bottom of the ball-striking face portion projects in front of the vertical, planar face, the top of the ball-striking face portion is located behind the vertical, planar face, and the face portion is angled backward from vertical at one of about 21, 25, 29, 33, 37, 41, 45, 49, 52, 56 or 60 degrees.

* * * * *